US009120641B2

(12) United States Patent
Iida et al.

(10) Patent No.: US 9,120,641 B2
(45) Date of Patent: Sep. 1, 2015

(54) ELECTRIC VEHICLE CHARGER

(75) Inventors: Takahide Iida, Kariya (JP); Masakatsu Sakuda, Nagakute (JP); Youichi Takahashi, Nagakute (JP)

(73) Assignees: Kabushiki Kaisha Toyota Jidoshokki (JP); Nitto Kogyo Corporation (JP)

( * ) Notice: Subject to any disclaimer, the term of this patent is extended or adjusted under 35 U.S.C. 154(b) by 661 days.

(21) Appl. No.: 13/398,086

(22) Filed: Feb. 16, 2012

(65) Prior Publication Data

US 2012/0212180 A1 Aug. 23, 2012

(30) Foreign Application Priority Data

Feb. 21, 2011 (JP) ..... 2011-034510

(51) Int. Cl.
*H02J 7/00* (2006.01)
*B65H 75/44* (2006.01)

(52) U.S. Cl.
CPC ..... *B65H 75/4476* (2013.01); *B65H 2701/34* (2013.01)

(58) Field of Classification Search
USPC ..... 320/109
See application file for complete search history.

(56) References Cited

U.S. PATENT DOCUMENTS 3,773,987 A * 11/1973 Davis et al. ..... 191/12.4
5,306,999 A * 4/1994 Hoffman ..... 320/109
6,909,259 B2 * 6/2005 Chung ..... 320/107
2001/0002786 A1 6/2001 Najima
2002/0104915 A1 8/2002 Hanlon
2010/0277127 A1 * 11/2010 Flack ..... 320/137

FOREIGN PATENT DOCUMENTS

| | | |
|---|---|---|
| CN | 2588726 Y | 11/2003 |
| JP | A-H11-122714 | 4/1999 |
| JP | 2010-110053 | 5/2010 |
| JP | 2010-115037 | 5/2010 |
| JP | A-2010-226817 | 10/2010 |
| JP | A-2010-283946 | 12/2010 |
| JP | 2011-034510 | 1/2011 |
| WO | WO 2009/091745 | 7/2009 |

OTHER PUBLICATIONS

Chinese Patent Application No. 201210031788.3: First Office Action dated Dec. 20, 2013, 15 pages.
French Patent Application No. 1251376, Preliminary Search Report, dated Feb. 26, 2013, 5 pages.

* cited by examiner

*Primary Examiner* — Edward Tso
*Assistant Examiner* — Robert Grant
(74) *Attorney, Agent, or Firm* — Baker & Hostetler LLP

(57) ABSTRACT

An electric vehicle charger includes: a first winder unit and a second winder unit for winding and holding a charging cable having a charging connector at its end portion; and a body unit for arranges the first winder unit and the second winder unit with the distance between the first winder unit and the second winder unit set longer than the diameter of the charging cable, wherein the charging cable passes between the first winder unit and the second winder unit, and the charging cable is fixed before passing between the first winder unit and the second winder unit.

6 Claims, 8 Drawing Sheets

FRONT VIEW

FRONT VIEW

ELECTRIC VEHICLE CHARGER

CROSS REFERENCE TO RELATED APPLICATION

This application is based upon and claims the benefit of priority of the prior Japanese Patent Application No. 2011-034510, filed on Feb. 21, 2011, the entire contents of which are incorporated herein by reference.

TECHNICAL FIELD

The present invention relates to an electric vehicle charger.

BACKGROUND

From the viewpoint of a compact electric vehicle charger used in charging an electric vehicle, a plug-in hybrid vehicle, etc., it is requested to compact and store a charging connector and a charging cable in a unitary construction.

For example, there is a vehicle charger connection cable storage box for easily compacting and storing a charging connection cable used in charging an electric vehicle, a plug-in hybrid vehicle, etc. The vehicle charger connection cable storage box includes: a vehicle charger connection cable having at one end a vehicle side connector a vehicle side connector for connection to a vehicle and at the other end an electric vehicle charger side connector; and a housing storing the cable so that the cable can be freely drawn from the end portion to the outside of the housing.

There is also an electric vehicle charging system for reducing the trouble of storing the body of a charging cable, reducing the possibility of damaging the body of the charging cable, and enhancing the security. The electric vehicle charging system includes a vehicle connector which can be arbitrarily removed from and connected to the vehicle side connector of an electric vehicle. It also includes a body of a charging cable to which the vehicle connector is connected through a charging cable, and which provides a commercial power supply for an electric vehicle, and a car port in which the electric vehicle is parked. The body of a charging cable is provided with a leakage breaker circuit for detecting a leakage and cutting off the charge to an electric vehicle. The pole of a car port is provided with a storage space for storing the body of a charging cable, and the body of the charging cable is held by the pole as stored in the storage space.

Japanese Laid-open Patent Publication No. 2010-115037.

Japanese Laid-open Patent Publication No. 2010-110053

SUMMARY

The present invention aims at providing an electric vehicle charger with which a user can wind a charging cable in a preferable direction.

A body unit of an electric vehicle charger as one of the aspects of the embodiment includes a first winder unit and a second winder unit for winding and holding the charging cable having a charging connector at its end portion. The body unit arranges the first winder unit and the second winder unit with the distance between the first winder unit and the second winder unit set longer than the diameter of the charging cable. The charging cable passes between the first winder unit and the second winder unit, and the charging cable is fixed to the body unit before passing between the first winder unit and the second winder unit.

In addition, a power supply unit is arranged at a position that allows the charging cable to pass between the first winder unit and the second winder unit. The charging cable is fixed to the body unit in the power supply unit.

Furthermore, a power supply unit is stored in one of the first winder unit and the second winder unit. With the configuration, a user can wind the charging cable in a preferable direction.

In addition, a fixing unit fixes the charging cable in the power supply unit in a substantially linear state, and the charging cable extends from a line outlet at a position between the first winder unit and the second winder unit in one direction.

In addition, a power supply unit is arranged at a position that allows the charging cable to pass between the first winder unit and the second winder unit, the power supply unit being provided externally. A fixing unit fixes the charging cable in the power supply unit in a substantially linear state, and the charging cable is connected to a cable for supplying the public electricity by a terminal block, is passed through a line outlet in a body unit from a back of the body unit, is arranged on the surface of the body unit, and is exited from the line outlet of the position in one direction.

DETAILED DESCRIPTION OF ILLUSTRATIVE EMBODIMENTS

From the viewpoint of a compact electric vehicle charger used in charging an electric vehicle, a plug-in hybrid vehicle, etc., it is requested to compact and store a charging connector and a charging cable in a unitary construction. However, it is common that an electric vehicle charger 1 is designed longer with enough length to be laid on the ground with sufficient slack during the charging operation. Therefore, the charging cable is subject to stains of soil, water, etc., and when a charging connector and a charging cable are stored together, the stains of soil, water, etc. on the charging cable adheres to the handle unit and the connector unit, which prevents appropriate charging operation. The stains of soil, water, etc. adheres to the connector unit is causes fault in the electric vehicle charger. Then, an electric vehicle charger is devised as having a charging cable winder unit for winding and holding the charging cable and a charging connector holding unit for holding the charging connector so that the charging connector is directed in the same direction as the winding direction of the charging cable with a partition for separating the charging connector holding unit from the charging cable winder unit.

However, if the winding direction of the charging cable is fixed as one direction, inconvenience for a user is anticipated. That is, depending on, for example, the dominant hand of a user, the winding direction of the charging cable can be different by each user. Therefore, a fixed winding direction will cause the inconvenience for a user. Furthermore, a different winding direction of the charging cable is anticipated by the location of the electric vehicle charger.

In the situation above, using the electric vehicle charger having: a first winder unit and a second winder unit for winding and holding a charging cable provided with a charging connector at its end portion; and a body unit having an arrangement of the first winder unit and the second winder unit with the distance between the first winder unit and the second winder unit longer than the diameter of the charging cable, the charging cable passes between the first winder unit and the second winder unit, and the charging cable is fixed before the passage between the first winder unit and the second winder unit. As a result, the charging cable can be wound in a preferable direction, and a use can appropriately perform the charging operation.

The embodiment is described below in detail with reference to the attached drawings.

The embodiment 1 is described below.

Figure 1:
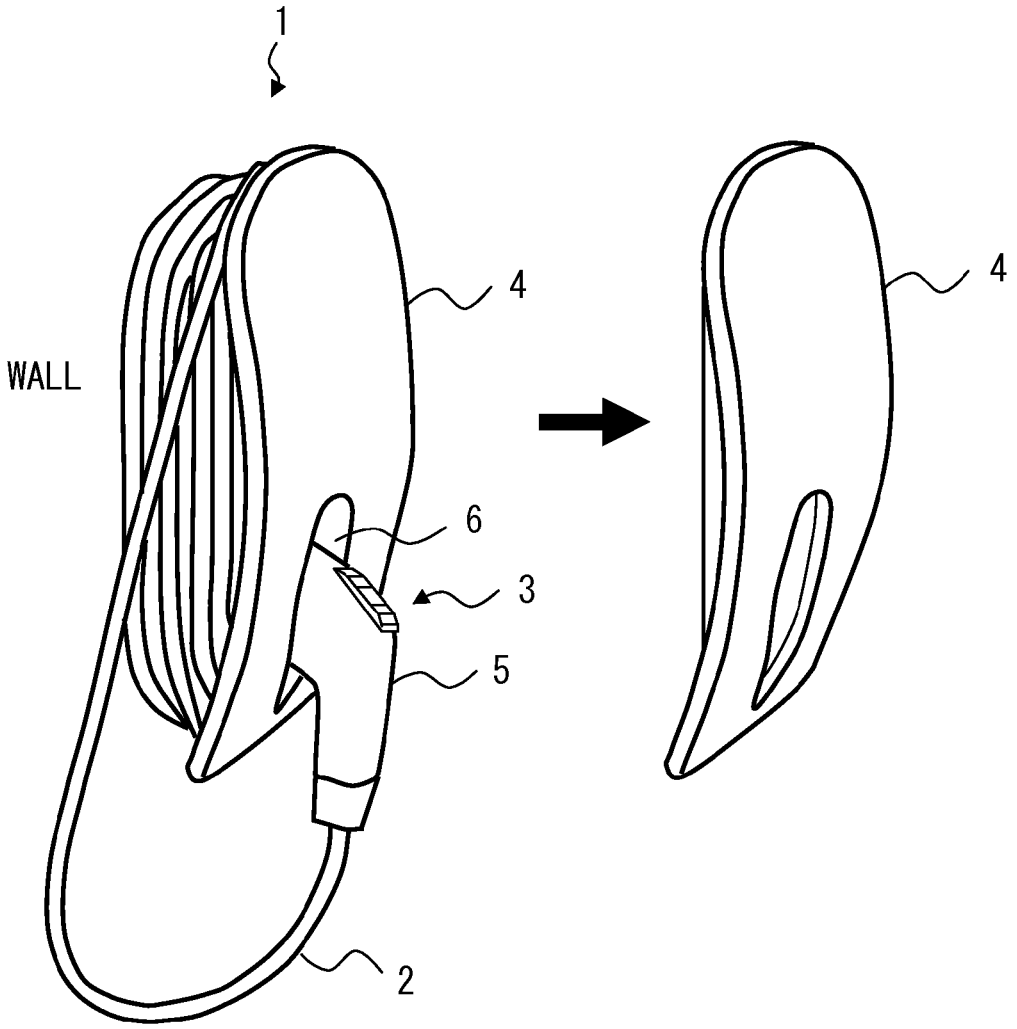
FIG. 1 is a perspective view of an embodiment of the electric vehicle charger according to the embodiment 1.

FIG. 1 is a perspective view of an embodiment of the electric vehicle charger according to the embodiment 1. An electric vehicle charger 1 illustrated in FIG. 1 includes a charging cable 2, a charging connector 3, and a cover 4, and has the structure of winding and holding the charging cable 2 on the side of the housing of the electric vehicle charger 1. The location of the installation of the electric vehicle charger 1 can be, for example, the wall of a home parking lot, etc. which is a fixed structure. The method of winding the charging cable 2 on the electric vehicle charger 1 can be realized by winding it around the entire housing of the electric vehicle charger 1 as illustrated in FIG. 1, but can also be realized by hanging the charging cable 2 at the upper portion of the electric vehicle charger 1 and winding the cable with sufficient slack not to touch the lower portion of the electric vehicle charger 1

The charging connector 3 is connected at the end of the charging cable 2. The charging connector 3 has an end portion to be connected to the charging plug provided for a vehicle for the charge to supply electric power to the vehicle, and a handle unit 5.

The cover 4 has a charging connector holding unit 6 for holding the charging connector 3. The position of the charging connector holding unit 6 is not limited to the lower part of the cover 4 as illustrated in FIG. 1, but can be at the central part, the upper part, etc. of the cover 4. The shape of the cover 4 is not limited to the shape illustrated in FIG. 1, but can be a circle, a substantially circular shape, an oval, a shape obtained by replacing the corners of a rectangle with arcs, a shape obtained by replacing the upper side of a rectangle with an arc, etc.

Figure 2:
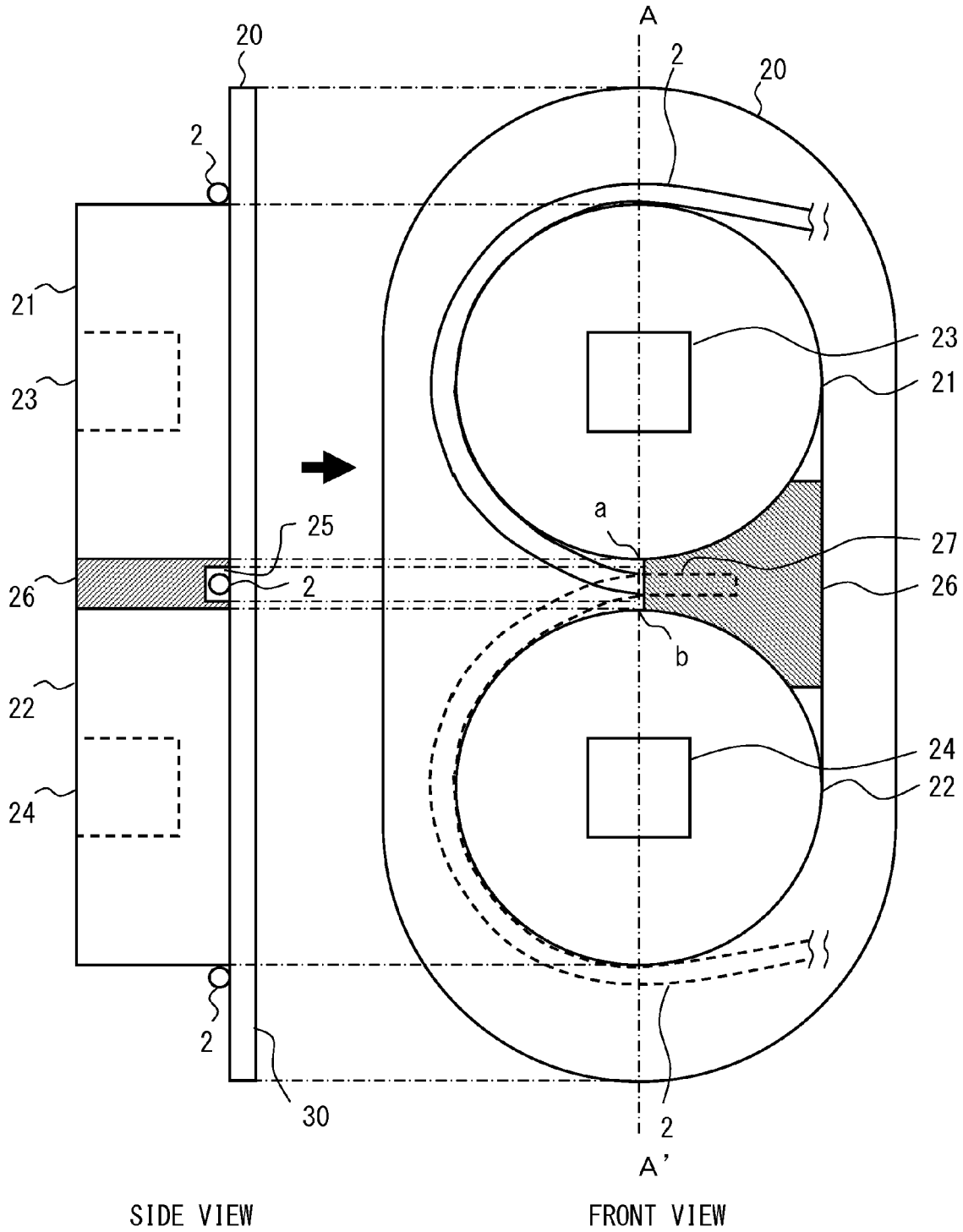
FIG. 2 is a front and sectional view of an embodiment of a housing with the cover removed from the electric vehicle charger.

FIG. 2 is a front and sectional view of an embodiment of a housing with the cover removed from the electric vehicle charger. The embodiment 1 is described below with reference to the front view and the side view of the housing with the cover 4 removed from the electric vehicle charger 1 illustrated in FIG. 1. The front view in FIG. 2 is a view from the cover 4 illustrated in FIG. 1. The side view in FIG. 2 is a sectional view of the housing of the electric vehicle charger 1 as cut along the dot-and-dash line A-A' illustrated in FIG. 2 and observed from the arrow direction. There is no dot-and-dash line actually, but it is illustrated in FIG. 2 for convenience in associating the front view with the side view. The charging cable 2 is indicated by the solid line when it is wound clockwise, and by a broken line when it is wound counterclockwise. In FIG. 2, two charging cables 2 are illustrated for convenience, but there is actually one charging cable 2.

The housing of the electric vehicle charger 1 is configured by a first winder unit 21, a second winder unit 22, and a body unit 20, and the body unit 20 is provided with the first winder unit 21 and the second winder unit 22. The first winder unit 21 and the second winder unit 22 is arranged by attaching them respectively at the upper part and the lower part of the body unit 20 so that the distance between the lower part a of the first winder unit 21 and the upper part b of the second winder unit 22 can be longer than the diameter of the cable of the charging cable 2.

The first winder unit 21 can be circular, substantially circular, oval, rectangular with the corners replaced with arcs, rectangular with the upper side replaced with arcs, etc. However, it is preferable that a necessary bend radius is guaranteed to prevent abnormal heat of the charging cable 2 for each shape. The second winder unit 22 can be circular, substantially circular, oval, rectangular with the corners replaced with arcs, rectangular with the upper side replaced with arcs, etc. However, it is preferable that a necessary bend radius is guaranteed to prevent abnormal heat of the charging cable 2 for each shape.

The first winder unit 21 and the second winder unit 22 can be formed as a unitary construction. In addition, when the unitary construction is realized, the distance between the first winder unit and the second winder unit is defined as the distance between the surfaces of the line outlet from which the charging cable can be drawn. That is, the distance is to be long enough to draw the charging cable.

In the case in FIG. 2, the first winder unit 21 and the second winder unit 22 are provided with attachment units 23 and 24, respectively, which are structures for removing and attaching the cover 4. The positions of the attachment units 23 and 24 are not limited to those illustrated in FIG. 2, but can be any positions in which the cover 4 can be removed and attached. In the embodiment 1, the cover 4 can be fixed to the first winder unit 21 and the second winder unit 22.

A reverse 30 of the body unit 20 is fixed to the surface of the fixed structure such as the wall of a home parking lot etc. In the present embodiment, the shape of the body unit 20 is rectangular with the corners replaced with arcs, but the shape is not specifically limited, that is, a circle, a substantial circle, an oval, an ellipse, a rectangle with the upper side replaced with an arc, etc. The first winder unit 21, the second winder unit 22, and the body unit 20 can be formed as a unitary construction. Furthermore, each of the first winder unit 21, the second winder unit 22, and the body unit 20 can be manufactured separately, and the first winder unit 21 and the second winder unit 22 can be attached to the body unit 20.

A power supply unit 26 storing parts used in supplying power to a vehicle is provided between the first winder unit 21 and the second winder unit 22, and is provided with a line outlet 25 through which the charging cable 2 is drawn. The power supply unit 26 stores a breaker, a power supply device such as charging control equipment etc. The charging cable 2 in the power supply unit 26 includes at least a fixing device for fixing the cable to the body unit 20 at the position before the point indicated by a-b in FIG. 2 in the power supply unit 26. For example, as a fixing unit 27 in FIG. 2, the charging cable 2 in the power supply unit 26 is fixed in a substantially linear state, and exits from the line outlet 25 in one direction. The fixing device can be, for example, a cable fixing metal etc.

The charging cable 2 drawn from the line outlet 25 is wound clockwise along the arc at the upper part of the first winder unit 21 in the case of the clockwise direction, and then wound along the arc at the lower part of the second winder unit 22. In the case of the counterclockwise direction, the cable is wound counterclockwise along the arc at the lower part of the second winder unit 22, and then wound along the arc at the upper part of the first winder unit 21. In FIG. 2, the clockwise direction is the direction of the charging cable 2 indicated by the solid line, and the counterclockwise direction is the direction of the charging cable 2 indicated by the broken line.

Figure 3:
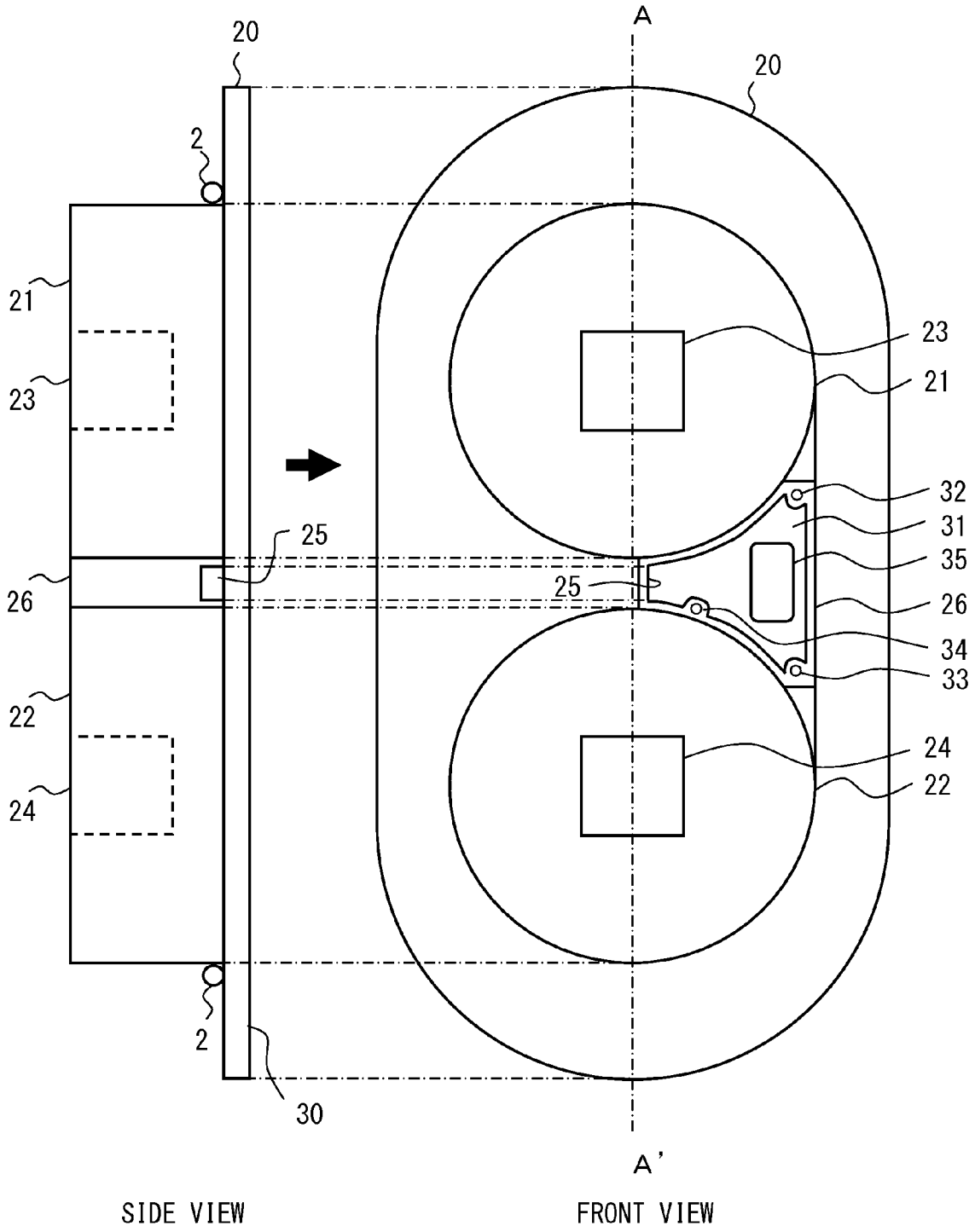
FIG. 3 is a front and sectional view of an embodiment with the top cover of the power supply unit of the electric vehicle charger illustrated in FIG. 2 removed.

FIG. 3 is a front and sectional view of an embodiment with the top cover of the power supply unit of the electric vehicle charger illustrated in FIG. 2 removed. In the example illustrated in FIG. 3, the power supply unit 26 has a space 31 in which a power supply device, a fixing device, etc. are arranged, and screw holes 32, 33, and 34 for fixing screws are provided for removing and attaching the top cover provided at the upper part of the power supply unit 26. In the present embodiment, the structure of fixing the top cover using screws is described, but the top cover can be fixed in other methods without using the screws. A hole 35 illustrated in FIG. 3 is provided for externally inserting a cable etc. for supply of public electricity. It is preferable that the power supply unit 26 is waterproof and drip-proof.

In the embodiment 1, the charging cable 2 in the power supply unit 26 is fixed to the 20 substantially linearly (fixing unit 27 in FIG. 2), drawn from the 25 in one direction, and passes between the first winder unit 21 and the second winder unit 22, thereby allowing a user to select a desired winding direction. The charging cable 2 is to be fixed before the position indicated by a-b illustrated in FIG. 2, that is, in a state other than the substantially linear state.

In addition, the charging connector and the charging cable can be compacted and stored together.

Furthermore, since the stains of soil, water, etc. attached on the charging cable can be kept away from the charging connector, the charging operation can be appropriately performed.

The embodiment 2 is described below.

Figure 4:
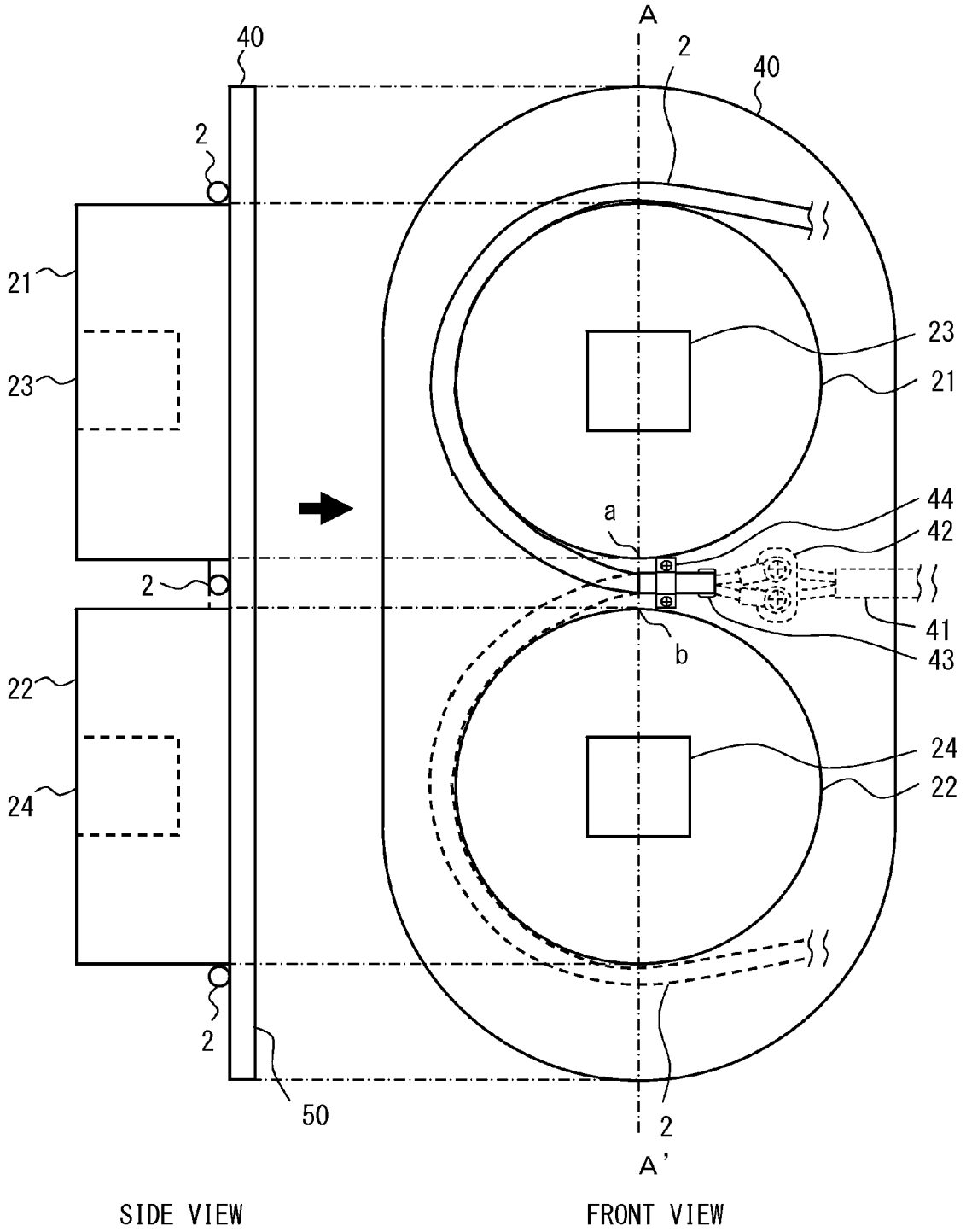
FIG. 4 is a front and sectional view of an embodiment when the power supply unit of an electric vehicle charger is provided externally.

FIG. 4 is a front and sectional view of an embodiment when the power supply unit of an electric vehicle charger is provided externally. The embodiment 2 is described below with reference to the front view and the side view of the housing according to the embodiment 2 with the cover 4 removed from the electric vehicle charger 1 illustrated in FIG. 1. The front view in FIG. 4 is a view from the cover 4 illustrated in FIG. 1. The side view in FIG. 4 is a sectional view of the housing of the electric vehicle charger according to the embodiment 2 as cut along the dot-and-dash line A-A' illustrated in FIG. 4 and observed from the arrow direction. There is no dot-and-dash line actually, but it is illustrated in FIG. 4 for convenience in associating the front view with the side view. The charging cable 2 is indicated by the solid line when it is wound clockwise, and by a broken line when it is wound counterclockwise. In FIG. 4, two charging cables 2 are illustrated for convenience, but there is actually one charging cable 2.

In the case of the embodiment 2, the power supply unit is provided externally, and power is supplied to the charging cable 2 through the cable for supplying the public electricity connected to the externally provided power supply unit. In the present embodiment, a cable 41 is connected to the charging cable 2 at a terminal block 42. The charging cable 2 passes through a line outlet 43 in a body unit 40 from a reverse 50 in the body unit 40, and is arranged on the surface of the body unit 40. Then, the charging cable 2 is fixed to the body unit 40 between the terminal block 42 and the position of a and b illustrated in FIG. 4 using a fixing device 44 so that the charging cable 2 can be substantially linear. Then, the charging cable 2 is drawn in one direction. The fixing device 44 can be, for example, a cable fixing metal etc.

The housing of the electric vehicle charger according to the embodiment 2 is configured by a first winder unit 21, a second winder unit 22, and a body unit 20, and the body unit 20 is provided with the first winder unit 21 and the second winder unit 22. The first winder unit 21 and the second winder unit 22 is arranged by attaching them respectively at the upper part and the lower part of the body unit 20 so that the distance between the lower part a of the first winder unit 21 and the upper part b of the second winder unit 22 can be longer than the diameter of the cable of the charging cable 2.

The first winder unit 21 can be circular, substantially circular, oval, rectangular with the corners replaced with arcs, rectangular with the upper side replaced with arcs, etc. However, it is preferable that a necessary bend radius is guaranteed to prevent abnormal heat of the charging cable 2 for each shape. The second winder unit 22 can be circular, substantially circular, oval, rectangular with the corners replaced with arcs, rectangular with the upper side replaced with arcs, etc. However, it is preferable that a necessary bend radius is guaranteed to prevent abnormal heat of the charging cable 2 for each shape.

In the case in FIG. 4, attachment units 23 and 24 are provided as a mechanism for removing and attaching the cover 4. The positions of the attachment units 23 and 24 are not limited to those illustrated in FIG. 4, but can be any positions in which the cover 4 can be removed and attached. In the embodiment 2, the cover 4 can be fixed to the first winder unit 21 and the second winder unit 22.

A reverse 50 of the body unit 40 is fixed to the surface of the fixed structure such as the wall of a home parking lot etc. In the present embodiment, the shape of the body unit 20 is rectangular with the corners replaced with arcs, but the shape is not specifically limited, that is, a circle, a substantial circle, an oval, an ellipse, a rectangle with the upper side replaced with an arc, etc. The first winder unit 21, the second winder unit 22, and the body unit 20 can be formed as a unitary construction. Furthermore, each of the first winder unit 21, the second winder unit 22, and the body unit 20 can be manufactured separately, and the first winder unit 21 and the second winder unit 22 can be attached to the body unit 20.

The charging cable 2 is wound clockwise along the arc at the upper part of the first winder unit 21 in the case of the clockwise direction, and then wound along the arc at the lower part of the second winder unit 22. In the case of the counterclockwise direction, the cable is wound counterclockwise along the arc at the lower part of the second winder unit 22, and then wound along the arc at the upper part of the first winder unit 21. In FIG. 4, the clockwise direction is the direction of the charging cable 2 indicated by the solid line, and the counterclockwise direction is the direction of the charging cable 2 indicated by the broken line.

In the embodiment 2, the charging cable 2 is fixed to the body unit 40 substantially linearly, and drawn from the line outlet 43 in one direction, and a user can select a desired winding direction by passing the charging cable 2 between the first winder unit 21 and the second winder unit 22. The charging cable 2 is to be fixed before the position indicated by a-b illustrated in FIG. 2, that is, in a state other than the substantially linear state.

In addition, the charging connector and the charging cable can be compacted and stored together.

Furthermore, since the stains of soil, water, etc. attached on the charging cable can be kept away from the charging connector, the charging operation can be appropriately performed.

The embodiment 3 is described below.

Figure 5:
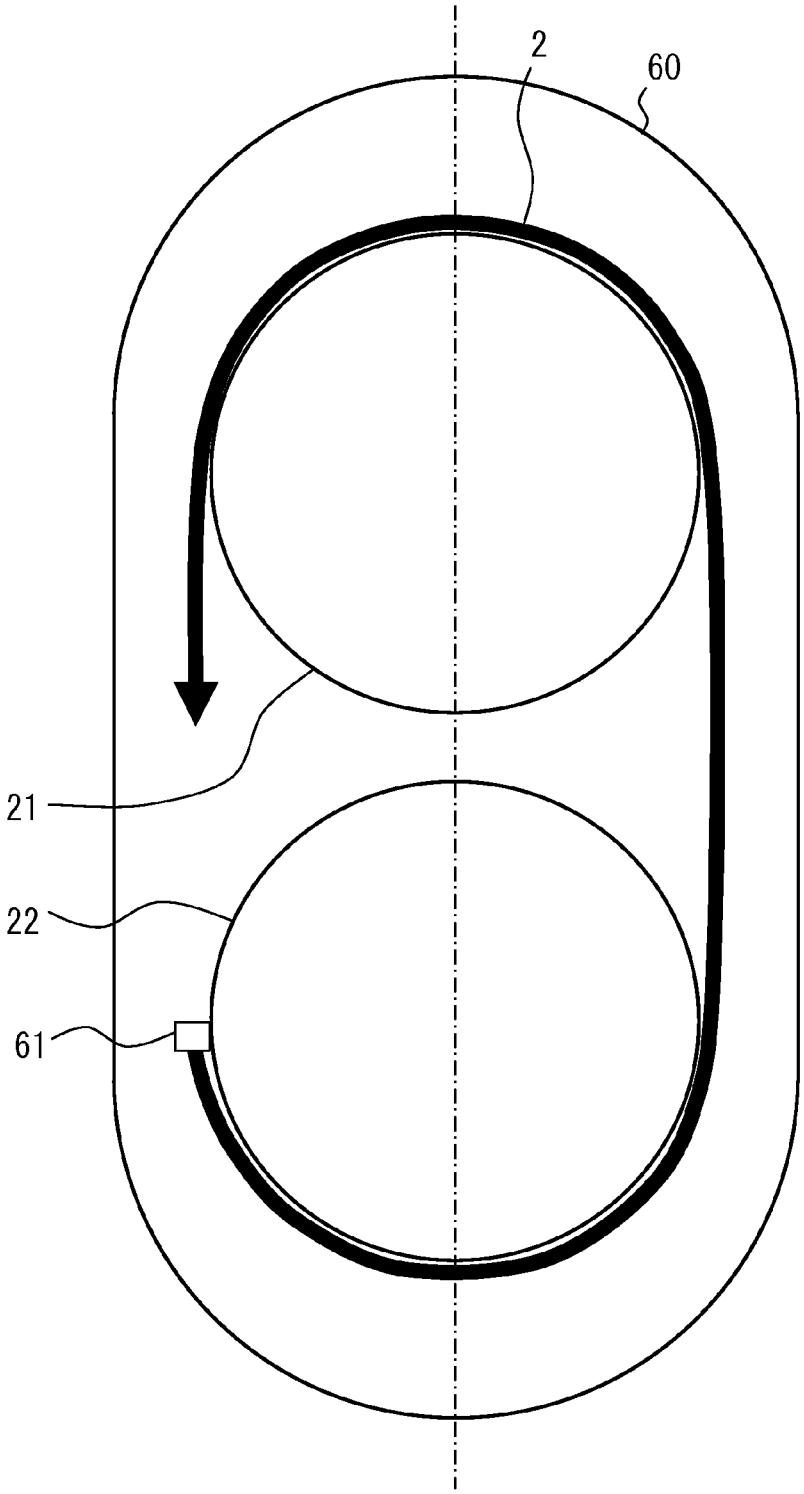
FIG. 5 is an embodiment of a method of winding a charging cable counterclockwise.
Figure 6:
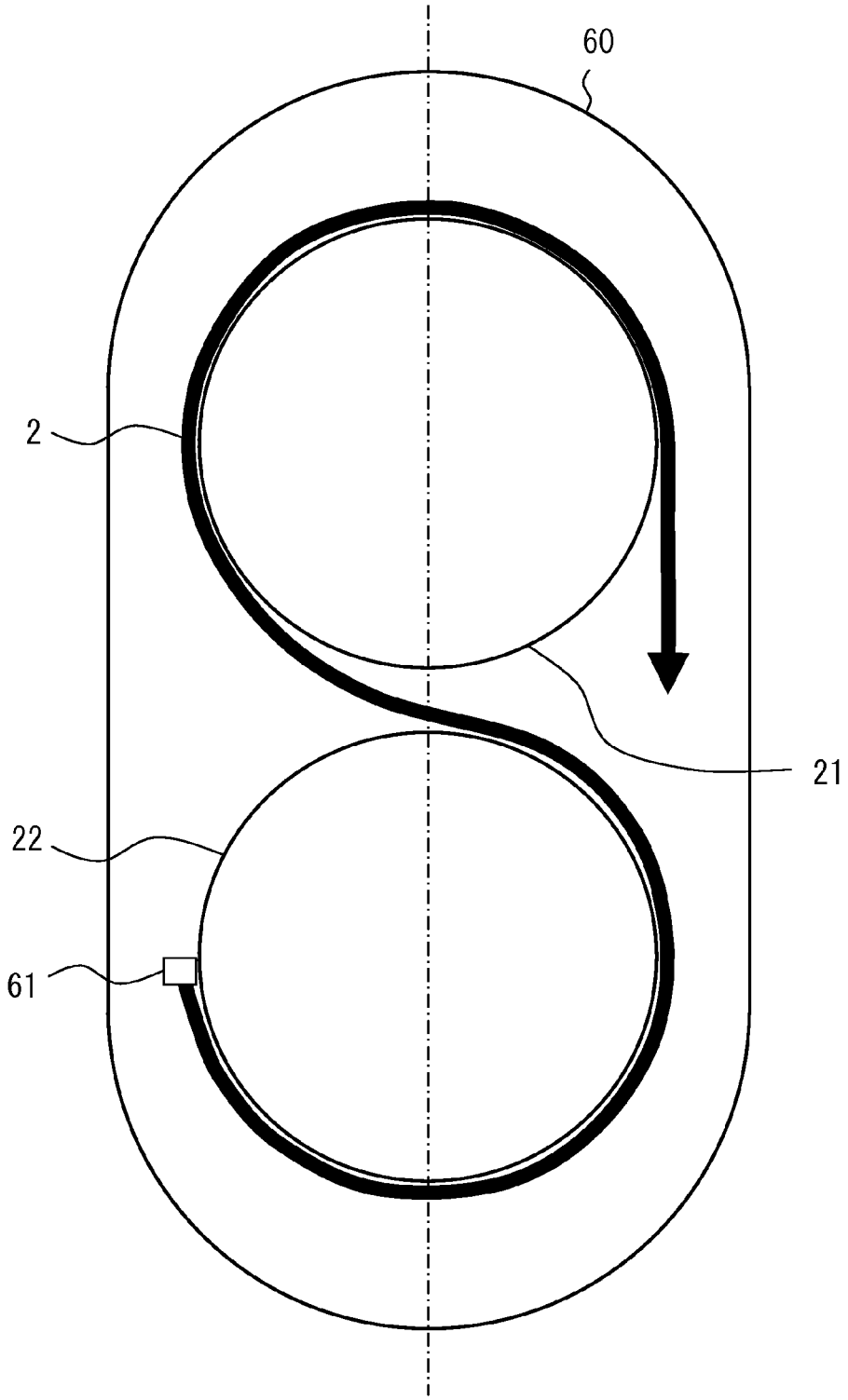
FIG. 6 is an embodiment of a method of winding a charging cable clockwise.

The embodiment 3 is a method of winding the charging cable 2 in a user desired direction when the position in which the charging cable 2 is fixed to a body unit 60 is not located between the first winder unit 21 and the second winder unit 22. FIG. 5 is an embodiment of a method of winding the charging cable 2 counterclockwise. FIG. 6 is an embodiment of a method of winding a charging cable 2 clockwise. FIGS. 5 and 6 are the figures viewed from the cover 4 side illustrated in FIG. 1. The first winder unit 21 and the second winder unit 22 are arranged on the body unit 60 of the embodiment 3 with the same arrangement as the first winder unit 21 and the second winder unit 22 illustrated with reference to the embodiments 1 and 2. However, the cover 4 has to be removed from and attached to the body unit 60. In addition, the first winder unit 21 and the second winder unit 22 has to be provided separately from each other so that the charging cable 2 can pass between the first winder unit 21 and the second winder unit 22.

For example, when the charging cable 2 is drawn from a position 61 as illustrated in FIGS. 5 and 6, it is not necessary for the charging cable 2 to pass between the first winder unit 21 and the second winder unit 22 when the charging cable 2 is wound counterclockwise. However, when the charging cable 2 is to be wound clockwise, it is to be wound after passing between the first winder unit 21 and the second winder unit 22. That is, a user passes the charging cable 2 between the first winder unit 21 and the second winder unit 22 after removing the cover 4. Then, the user attaches the cover 4 to the body unit 60, and then winds the charging cable 2 clockwise.

In the embodiment 3, when the drawing position of the charging cable 2 is on the body unit 60 on the periphery of the first winder unit 21 or the second winder unit 22, or on the peripheral side, the user can select the desired winding direction if the cover 4 can be removed and attached and the cable can pass between the first winder unit 21 and second winder unit 22.

In addition, the charging connector and the charging cable can be compacted and stored together.

Furthermore, since the stains of soil, water, etc. attached on the charging cable can be kept away from the charging connector, the charging operation can be appropriately performed.

The embodiment 4 is described below.

Figure 7:
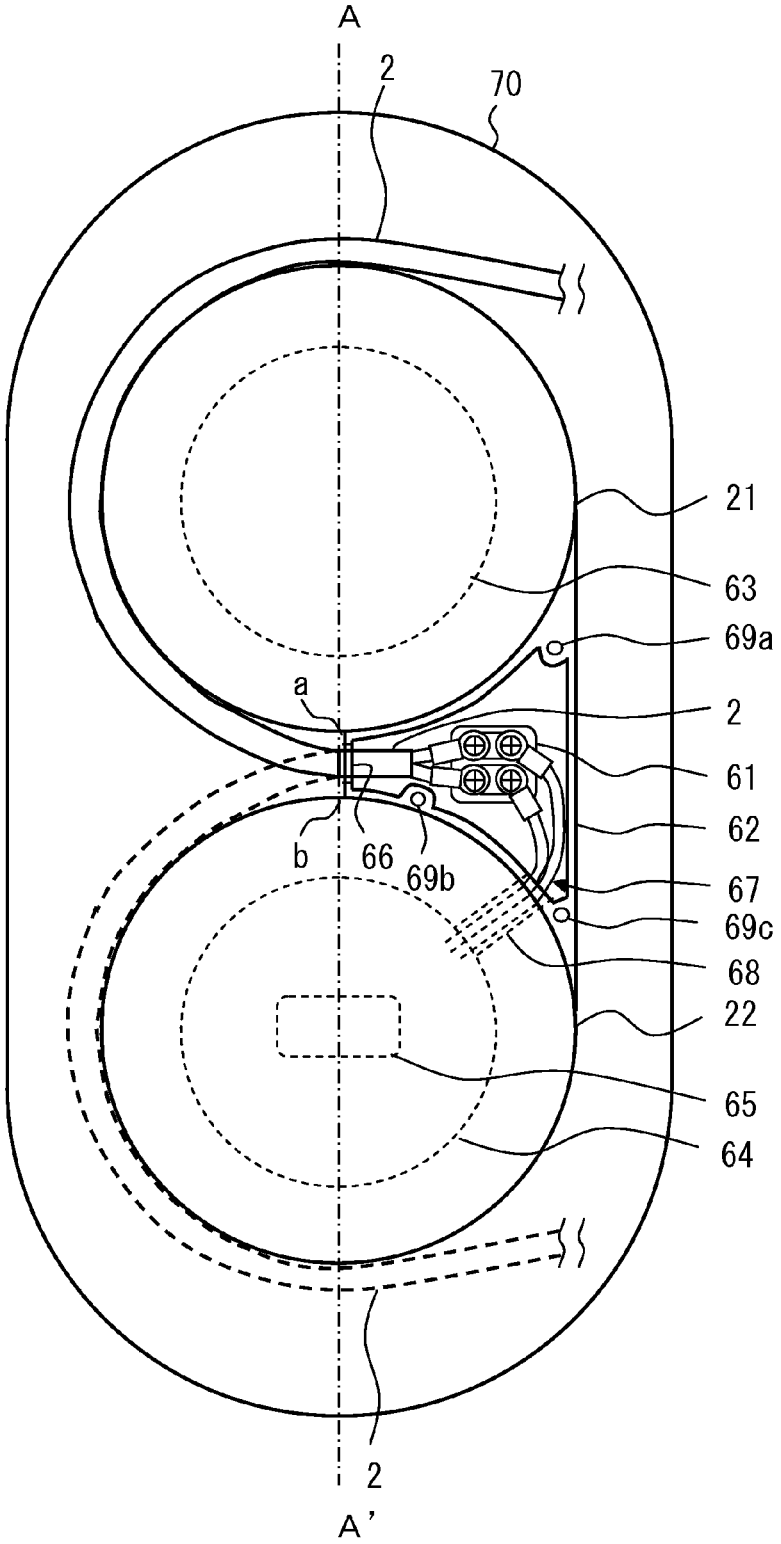
FIG. 7 is a front view of an embodiment when the power supply unit of an electric vehicle charger is provided in a winding unit.

FIG. 7 is a front view of an embodiment when the power supply unit of an electric vehicle charger is provided in a winding unit. The embodiment 4 is described below using the front view of the housing according to the embodiment 4 in which the cover 4 is removed from the electric vehicle charger. The front view in FIG. 7 is acquired as viewed from the cover 4 side illustrated in FIG. 1. The charging cable 2 is indicated by the solid line when it is wound clockwise, and by a broken line when it is wound counterclockwise. In FIG. 7, two charging cables 2 are illustrated for convenience, but there is actually one charging cable 2.

The housing of the electric vehicle charger according to the embodiment 4 is configured by a first winder unit 21, a second winder unit 22, and a body unit 70, and the body unit 70 is provided with the first winder unit 21 and the second winder unit 22. The first winder unit 21 and the second winder unit 22 is arranged by attaching them respectively at the upper part and the lower part of the body unit 70 so that the distance between the lower part a of the first winder unit 21 and the upper part b of the second winder unit 22 can be longer than the diameter of the cable of the charging cable 2.

The first winder unit 21 can be circular, substantially circular, oval, rectangular with the corners replaced with arcs, rectangular with the upper side replaced with arcs, etc. However, it is preferable that a necessary bend radius is guaranteed to prevent abnormal heat of the charging cable 2 for each shape. The second winder unit 22 can be circular, substantially circular, oval, rectangular with the corners replaced with arcs, rectangular with the upper side replaced with arcs, etc. However, it is preferable that a necessary band radius is guaranteed to prevent abnormal heat of the charging cable 2 for each shape.

Figure 8:
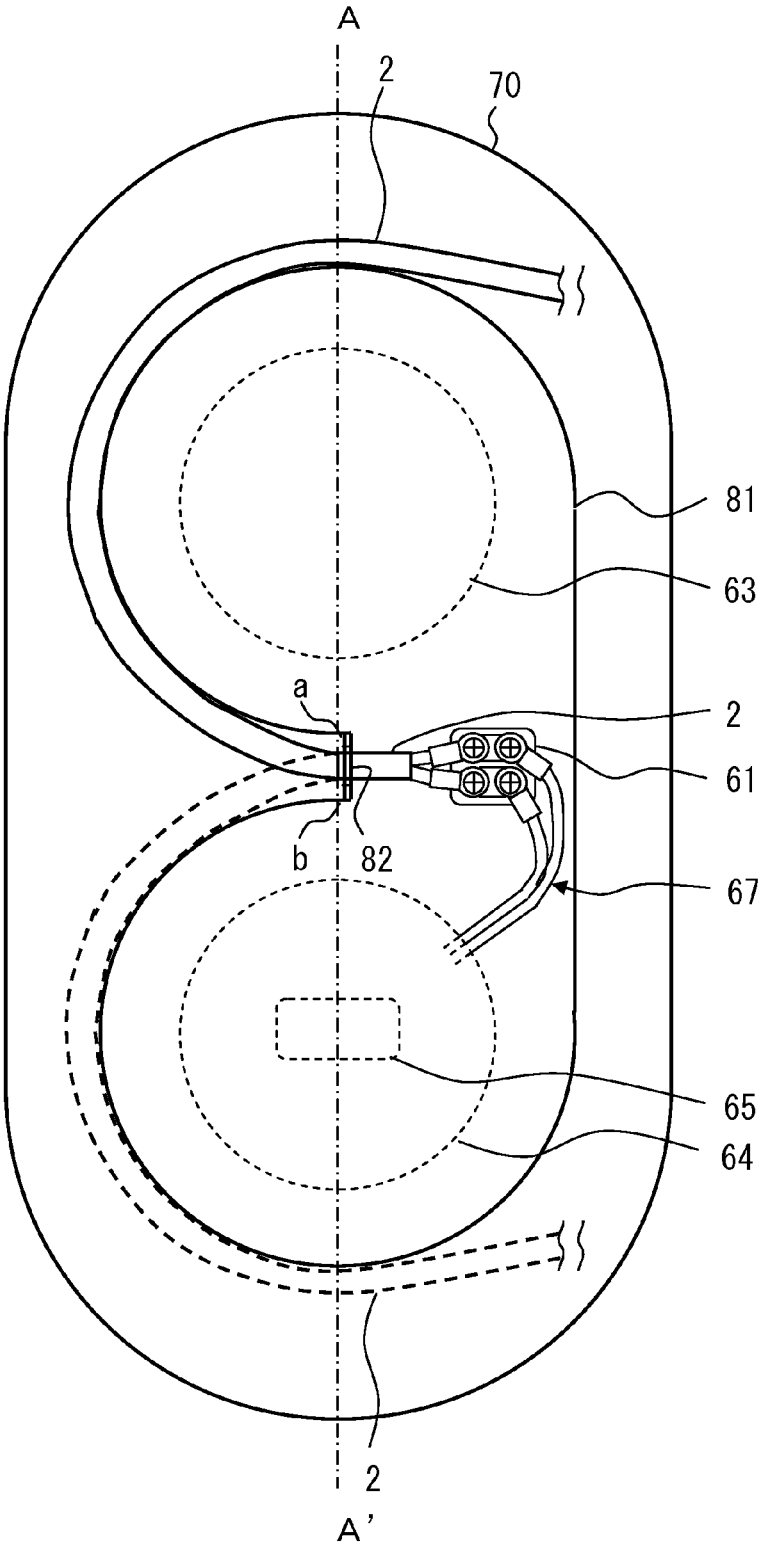
FIG. 8 is a front view of a variation of an embodiment when the power supply unit of an electric vehicle charger is provided in a power supply unit.

The first winder unit 21 and the second winder unit 22 illustrated in FIG. 7 can be formed as a unitary construction as a winding unit 81 illustrated in FIG. 8. In this case, the distance between the first winder unit and the second winder unit of the winding unit 81 is defined as the distance between the surfaces of a line outlet 82 from which the charging cable can be drawn. That is, the distance is to be long enough to draw the charging cable.

A reverse of the body unit 70 is fixed to the surface of the fixed structure such as the wall of a home parking lot etc. In the present embodiment, the shape of the body unit 70 is rectangular with the corners replaced with arcs, but the shape is not specifically limited, that is, a circle, a substantial circle, an oval, an ellipse, a rectangle with the upper side replaced with an arc, etc. The first winder unit 21, the second winder unit 22, and the body unit 70 can be formed as a unitary construction. Furthermore, each of the first winder unit 21, the second winder unit 22, and the body unit 70 can be manufactured separately, and the first winder unit 21 and the second winder unit 22 can be attached to the body unit 70.

The charging cable 2 is wound clockwise along the arc at the upper part of the first winder unit 21 in the case of the clockwise direction, and then wound along the arc at the lower part of the second winder unit 22. In the case of the counterclockwise direction, the cable is wound counterclockwise along the arc at the lower part of the second winder unit 22, and then wound along the arc at the upper part of the first winder unit 21. In FIG. 7, the clockwise direction is the direction of the charging cable 2 indicated by the solid line, and the counterclockwise direction is the direction of the charging cable 2 indicated by the broken line.

In FIG. 7, a terminal block 61 is provided in a storage unit 62. The terminal block 61 connects a cable 67 connected to the power supply device configured by a breaker in a power supply unit 64, a charging control equipment, etc. to the charging cable 2. The power supply unit 64 is a space in which the power supply device can be arranged in the second winder unit 22 in the present embodiment, and the power supply device is arranged in the space. In addition, in the present embodiment, an aperture 68 through which the cable 67 can pass is provided in the second winder unit 22. Although a power supply device is provided for the second winder unit 22 in the present embodiment, the power supply device can be arranged in the first winder unit 21. In this case, the power supply unit is arranged at the position 63 illustrated in FIG. 7.

It is preferable that the necessary bend radius for protection against the constant heat of the cable 67 is shorter than the necessary bend radius for protection against the constant heat of the charging cable 2.

The storage unit 62 stores the terminal block 61, a fixing device (not illustrated in the attached drawings) to the body unit 70, etc. Screw holes 69*a*, 69*b*, and 69*c* for fixing screws are provided for removing and attaching the top cover provided at the upper part of the storage unit 62. In the present embodiment, the structure of fixing the top cover using screws is described, but the top cover can be fixed in other methods without using the screws. A hole 65 illustrated in FIG. 7 is provided for externally inserting a cable etc. for supply of public electricity. It is preferable that the storage unit 62 and the power supply unit 64 are waterproof and drip-proof.

The charging cable 2 is fixed to the body unit 70 between the terminal block 61 and the position of a and b illustrated in FIG. 7 using a fixing device so that the charging cable 2 can be substantially linear. Then, the charging cable 2 is drawn in one direction. The fixing device can be, for example, a cable fixing metal etc. The charging cable 2 can be fixed before the position indicated by a-b in FIG. 7, and in a state other than the substantially linear state.

In the embodiment 4, the charging cable 2 is fixed substantially linearly, and drawn in one direction from a line outlet 66 of the storage unit 62, and a user can select a desired winding direction by passing the charging cable 2 between the first winder unit 21 and the second winder unit 22.

In addition, the charging connector and the charging cable can be compacted and stored together.

Furthermore, since the stains of soil, water, etc. attached on the charging cable can be kept away from the charging connector, the charging operation can be appropriately performed.

With the electric vehicle charger as described above according to the embodiments 1, 2, 3, and 4, the first winder unit 21 and the second winder unit 22 are arranged upper and lower with respect to the body unit, and attached to the wall of the body unit etc., but the body unit can be rotated by 90°.

The present invention is not limited to the embodiments above, but can be improved and varied with the scope of the gist of the present invention.

What is claimed:

1. An electric vehicle charger, comprising:

a first winder unit and a second winder unit holding a charging cable wound around outer peripheries of the first winder unit and the second winder unit, the charging cable having a charging connector at an end portion;

a body unit that arranges the first winder unit and the second winder unit with a distance between the first winder unit and the second winder unit set longer than a diameter of the charging cable; and a fixing unit that fixes the charging cable to the body unit, the fixing unit being arranged in a space between the first winder unit and the second winder unit or the outer periphery of the first winder unit or the second winder unit, wherein the charging cable passes between the first winder unit and the second winder unit.

2. The electric vehicle charger according to claim 1, wherein a power supply unit is arranged so as to allow the charging cable to pass between the first winder unit and the second winder unit.

3. The electric vehicle charger according to claim 2, wherein the power supply unit is provided in the body unit, and the charging cable is fixed to the power supply unit.

4. The electric vehicle charger according to claim 1, wherein a power supply unit is stored in one of the first winder unit and the second winder unit.

5. The electric vehicle charger according to claim 3, wherein the fixing unit fixes the charging cable in the power supply unit in a substantially linear state, and the charging cable extends from a line outlet at a position between the first winder unit and the second winder unit in one direction.

6. The electric vehicle charger according to claim 1, wherein a power supply unit is arranged at a position that allows the charging cable to pass between the first winder unit and the second winder unit, the power supply unit being provided externally, the fixing unit fixes the charging cable in the power supply unit in a substantially linear state, and the charging cable is connected to a cable for supplying the public electricity by a terminal block, is passed through a line outlet in a body unit from a back of the body unit, is arranged on the surface of the body unit, and is exited from the line outlet of the position in one direction.

* * * * *